US006592197B2

(12) United States Patent
Dinares et al.

(10) Patent No.: US 6,592,197 B2
(45) Date of Patent: Jul. 15, 2003

(54) PRINTER DEVICE AND METHOD

(75) Inventors: Maria Dinares, Barcelona (ES); Pere Josep Canti, Barcelona (ES); Elizabeth Zapata, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/920,703

(22) Filed: Jul. 31, 2001

(65) Prior Publication Data

US 2003/0025747 A1 Feb. 6, 2003

(51) Int. Cl.[7] ..... B41J 29/38; B41J 2/145

(52) U.S. Cl. ..... 347/12; 347/40

(58) Field of Search ..... 347/12, 40

(56) References Cited

U.S. PATENT DOCUMENTS 6,217,143 B1 * 4/2001 Munakata et al. ..... 347/16
6,264,384 B1 * 7/2001 Lee et al. ..... 400/322

* cited by examiner

*Primary Examiner*—Anh T.N. Vo
*Assistant Examiner*—Alfred E. Dudding
(74) *Attorney, Agent, or Firm*—Peter I. Lippman

(57) ABSTRACT

To decrease the total time required for feeding an inkjet printing medium to print an image, swath heights are reduced to values that depend on overall image height. A processor in the printer works out the swath height that just corresponds to an integral number of print-medium advances, over the total height of the image; and then prints the image using this swath height. This strategy optimizes throughput by minimizing the time occupied in advancing the print medium and in adjusting the print-medium position.

23 Claims, 3 Drawing Sheets

PRINTER DEVICE AND METHOD

FIELD OF THE INVENTION

The present invention relates generally to a printer device employing a scanning printing head, but particularly, although not exclusively, to a method of increasing the throughput of an inkjet printer device and the corresponding apparatus.

BACKGROUND OF THE INVENTION

Inkjet printer devices generally incorporate one or more inkjet cartridges, often called "pens", which shoot drops of ink onto a page or sheet of print media. For instance, two earlier thermal ink ejection mechanisms are shown in U.S. Pat. Nos. 5,278,584 and 4,683,481, both assigned to the present assignee, Hewlett-Packard Company. The pens are usually mounted on a carriage, which is arranged to scan across a scan axis relative to a sheet of print media as the pens print a series of individual drops of ink on the print media forming a band or "swath" of an image, such as a picture, chart or text.

Inkjet printers are generally arranged to print in a variety of print modes that offer differing trade-offs between print quality and throughput. In high throughput modes, the print media may be advanced relative to the carriage by a distance equal to the height of a swath once a given swath is printed. In this manner, a further swath may then be printed adjacent to the earlier swath. By a repetition of this process, a complete printed page may be produced in an incremental manner.

Over recent years, the importance placed on the throughput of ink jet printers has risen dramatically. Throughput is generally measured as the number of pages of a given size, or the area of print media that a printer may ink in a given time. Consequently, manufacturers of inkjet devices have embarked on a process of continually improving their inkjet printers to give improved throughput in order to secure a competitive edge in the marketplace.

Throughput is directly related to the speed at which each swath may be printed. Therefore, in order to enable higher throughputs, inkjet devices have been developed to print at higher carriage speeds, thus allowing more swaths to be printed in a given time. However, as the carriage speed increases above a certain point, the print quality tends to deteriorate. In many cases it is preferable to print images of higher quality at a lower throughput than lower quality images at a higher throughput. Consequently, inkjet printers are being continually redeveloped to use printheads having increasingly large swath heights. By using printheads with larger swath heights, fewer swaths are needed to print a given print job. Thus, throughput may be increased.

However, even with the advent of printheads with a swath height of approximately an inch, and the prospect of printheads with significantly greater swath heights being developed in the future, the demand for yet further increases in throughput remains. This is particularly true as inkjet technology is now being used or considered for use in fields traditionally dominated by other technologies.

It would therefore be desirable to provide an improved inkjet device and a method of operating an inkjet printer that addresses the problems of the prior art.

SUMMARY OF THE INVENTION

According to the present invention there is provided an inkjet device comprising a printhead and a media advance mechanism, the printhead being arranged to print swaths aligned in a first direction, each swath having a width in a second direction substantially perpendicular to said first direction, said media advance mechanism being arranged to feed a print medium relative to said print head to position said swaths in the second direction on the print medium, the device being arranged to print an image having a length in said second direction and comprising a plurality of swaths spaced apart in said second direction, said device being further arranged to reduce the width of one or more of said plurality of swaths in dependence upon the image length in order to reduce the total time to feed said print medium.

The inventors of the present invention realised that, paradoxically, by reducing the swath height used to print an image, the throughput of the printer may be increased.

When printing an image with an inkjet printer, the exact distance by which the print media must be advanced must, in general, be controlled very accurately in order to ensure good registration between consecutive swaths. This is carried out while the printer is not printing; i.e. in between swaths. Experience has shown that to advance the print media with sufficient precision generally requires a period of time that is significantly longer than the time required for the printer carriage to "overtravel" beyond the edge of the print media, having completed one swath, to decelerate and then re-accelerate in the reverse direction prior to printing a further swath. Thus, the print media advance time has a direct impact on the time taken to print an image.

It frequently arises that the length of the image in the direction perpendicular to the scan axis (image length) is a non-integer multiple of the swath height of the printheads. This means that only a fraction of the swath height of the printheads remains to be printed in the last pass of the printheads over the print medium. The inventors of the present invention realised that in such cases, fixed media advances of the prior art gives rise to a non-optimal total time required to advance the print media in printing an image.

In such cases, an image or print job, is, according to one aspect of the present invention, printed using swaths of reduced height, by using only selected printhead nozzles. Preferably, the printer uses a reduced swath height which is equal to the largest fraction of the maximum swath height of said printhead for which the said image length is an integer multiple. This in turn proportionally reduces the distance of media advances between swaths. By reducing the swath height to the largest fraction of the printhead swath height of which the image length is an integer multiple, the total media feed time may be optimised, without increasing the number of swaths required to print the image. In this manner, the time required to print the image may be reduced and the throughput of the printer correspondingly increased.

The degree to which the throughput may be increased in this manner is dependent upon several factors. These include: the minimum number of swaths required to print the image; and, the proportion of the full printhead swath height that would normally be printed in the last pass using constant media advances, when printing a given image. However, in general, the invention is best suited to printers having a large swath height, and furthermore to printers having a swath height that large in relation to the length of the image. The throughput advantages of the present invention are particularly beneficial in devices required to print many images, or copies of an image, rapidly. For example, wherein the inkjet device is being used in the role of the printing engine of a photocopier.

The present invention also extends to the method corresponding to the method. Furthermore, the present invention also extends to a computer program, arranged to implement the method of the present invention.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE INVENTION

There will now be described, by way of example only, the best mode contemplated by the inventors for carrying out the invention. The following embodiments use single pass, bi-directional print modes. However, the skilled reader will appreciate that the present invention may also be used to advantage in unidirectional printmodes and/or printmodes having a different number of passes.

System of the First Embodiment

Figure 1:
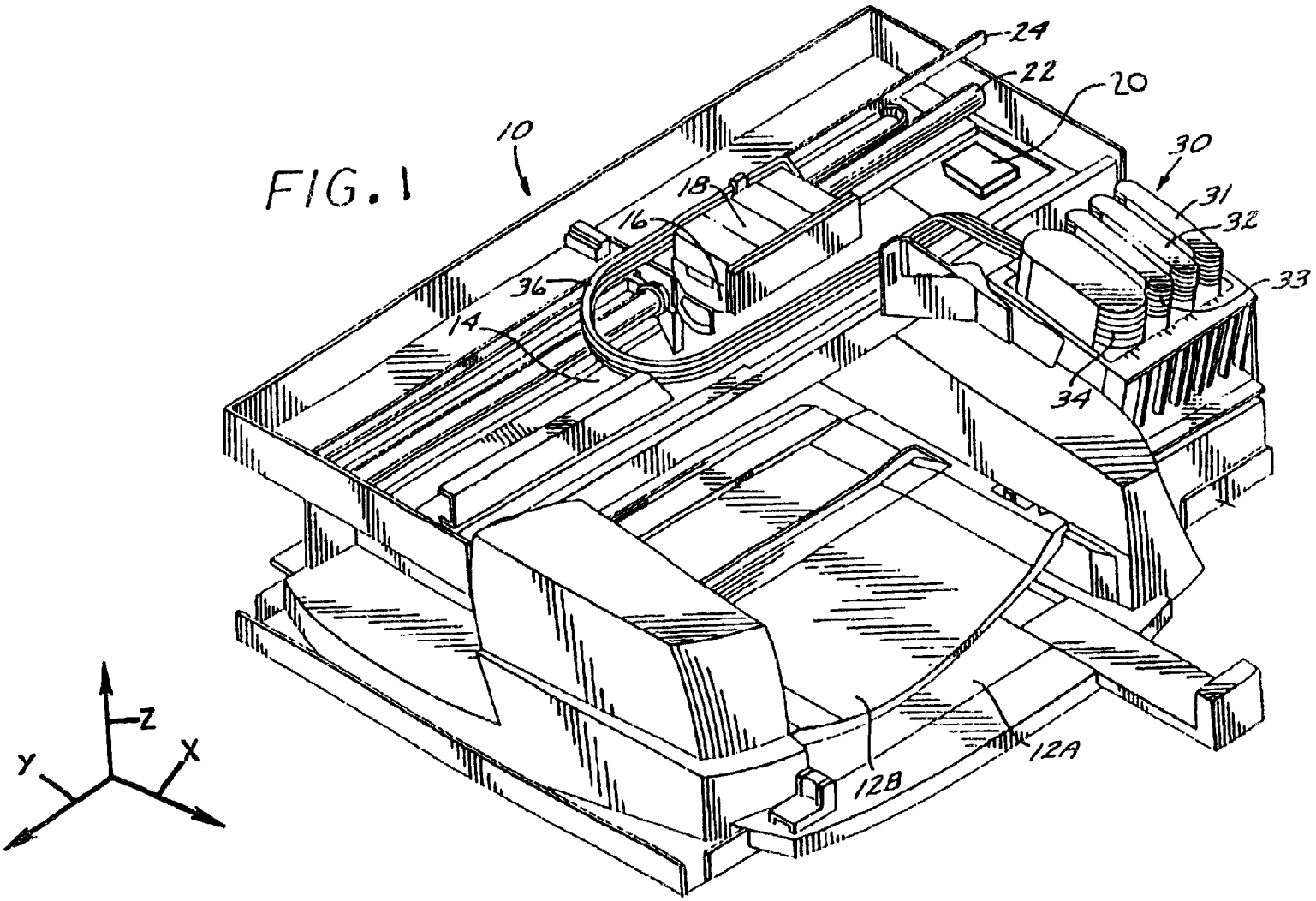
FIG. 1 shows a perspective view of an inkjet printer incorporating the features to the present invention.

FIG. 1 illustrates an exemplary embodiment of an inkjet printer 10, with its cover removed, which is suitable for use with the present invention. The printer 10 may be used for printing conventional engineering and architectural drawings, as well as high quality photographs or posters. Commonly assigned U.S. Pat. No. 5,835,108, entitled "Calibration technique for misdirected inkjet printhead nozzles", describes an exemplary system which can employ aspects of this invention and the entire contents of which are incorporated herein by reference.

The printer 10 has a printer controller 20, illustrated schematically as a microprocessor 30 that receives instructions from a host device, which is typically a computer, such as a personal computer or a computer aided drafting (CAD) computer system (not shown). The printer controller 20 has associated memory (not shown), which includes ROM and RAM. Image data, which is downloaded from a host device, may be stored in the RAM prior to being printed. The ROM stores operating instructions, which the printer controller 20 accesses in order to carry out the functions of the printer.

When a printing operation is initiated, a sheet of paper is fed into the printer using a conventional sheet feeding mechanism from a tray 12*a* which is arranged to hold an input supply of paper (not shown) or other print media such as transparencies and the like. The sheet is then brought around in a U direction to travel in the opposite direction towards the output tray 12*b*. The sheet is then stopped in a print zone 14 in order to allow a printing operation to be performed.

The printer has a scanning carriage 16, containing one or more print cartridges 18, that are arranged to scan (in the Y-axis) across a sheet of print media in order to print a swath of ink thereon. As is customary in the art, each of the four print cartridges 18 are positioned in the carriage 16 such that the swath printed by each cartridge 18 coincides with that of the other 3 print cartridges 18. The carriage scanning mechanism may be conventional and generally includes a carriage guide rod 22, defining a scanning axis, along which the carriage 16 scans, a coded strip 24, which is optically detected by a photo-detector associated with the carriage 16 for precisely positioning the carriage 16. A conventional carriage drive motor (not shown), such as a stepper motor, is connected to the carriage 16 via a conventional drive belt and pulley arrangement may be used to propel the carriage 16 across the print zone 14.

After a single scan or multiple scans, the sheet is incrementally fed in the X-axis by a stepper motor and feed rollers or other conventional print media handling system (not shown) to advance the sheet of print media to a further position in the printzone 14.

The carriage position in the Y-axis and the position of the print media in the X-axis is output to the print controller 20. In this manner, the print controller 20 may generate control signals causing the carriage assembly 16 to be moved in the Y-axis and the print media to be moved in the X-axis, such that the print cartridges 18 may print ink at any desired location on the printing area of the print medium.

In this manner the carriage 16 then scans across the sheet a further time, printing a further swath; thus building up a completed image. When the printing on the sheet is complete, the sheet is forwarded to a position above the tray 12*b*, held in that position in order to ensure that the ink is dry and then released.

The illustrated printer 10 uses an "off-axis" ink delivery system having replaceable ink supply cartridges 31–34, located "off-axis" from the path of printhead travel. The ink from the ink supply cartridges 31–34 is conveyed through a conventional flexible tubing system 36 from to the respective print cartridges 18. In this manner, only a small ink supply is propelled by carriage 16 across the printzone 14.

Each of the print cartridges 18, often called "pens" those in the art, has a printhead with an orifice plate with a plurality of nozzles formed therethrough, in a manner well known to those skilled in the art, through which drops of ink may be selectively ejected to form an image on a sheet of print media. In the present embodiment, each of the cartridges 18 is arranged to print one of the following colour inks: cyan; magenta; yellow and black. The print cartridges 18 have a large print swath (i.e. the height of the band of ink that may be printed in one pass of the printhead), about 25 millimetres (about one inch) wide, although cartridges with different swath heights may also be used.

In the present embodiment, the printheads are thermal inkjet printheads, although other types of printheads may be used, such as piezoelectric printheads.

Method of Operation of the First Embodiment

Figure 2:
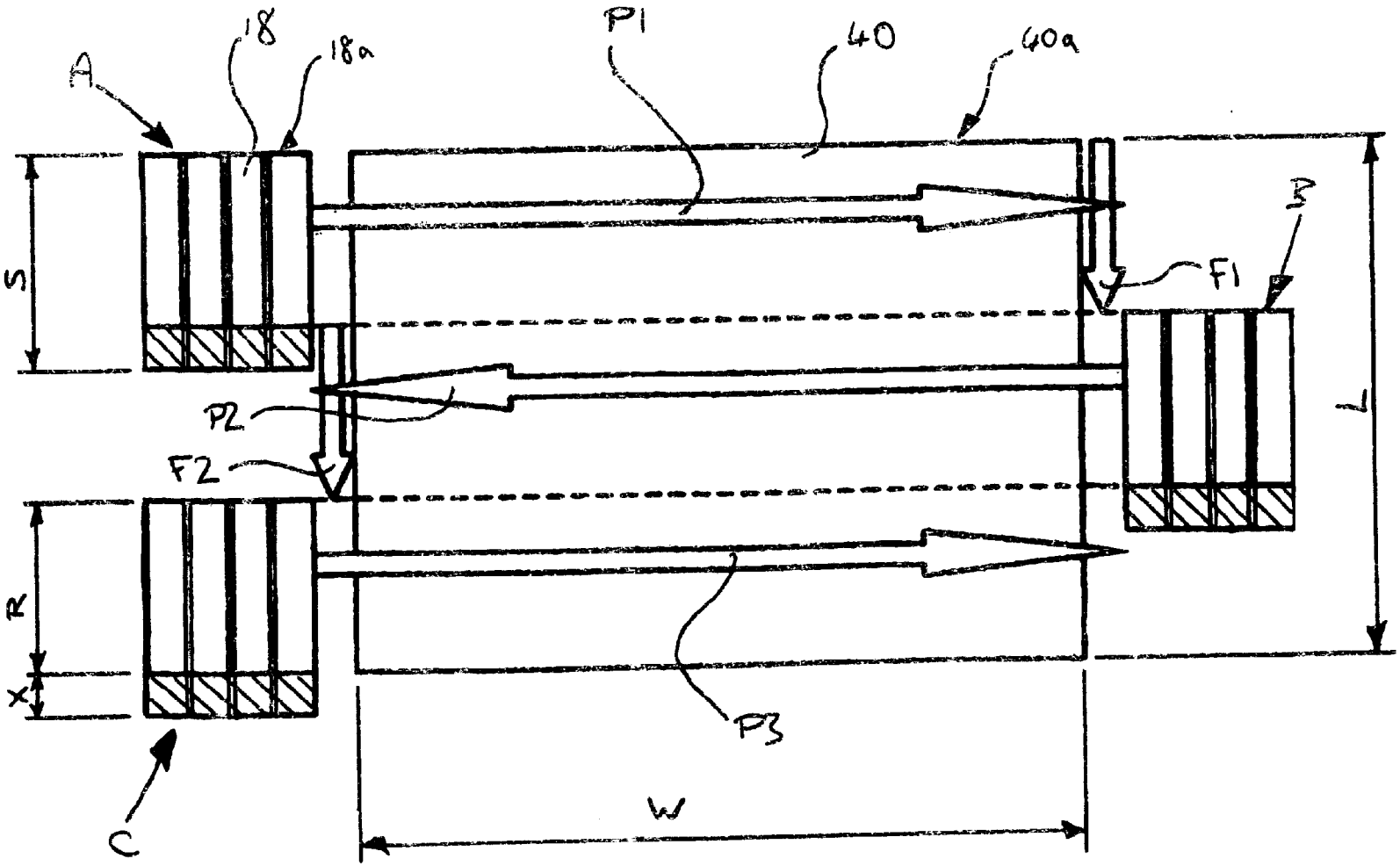
FIG. 2 schematically illustrates the mode of operation of the first embodiment of the invention.

Referring to FIG. 2, the operation of the present embodiment of the invention will now be described.

FIG. 2 illustrates a schematic plan view of a sheet of print media 40 as it is printed on in the print zone 14 of the printer 10, according to the method of the present embodiment.

Also shown in the figure is the position of the four print cartridges 18 of the printer 10 relative to the sheet 40, shown at three separate instants during the printing of an exemplary image on the sheet 40. The three positions are referenced "A", "B" and "C". For the sake of clarity, the printer carriage 16 and further components of the printer 10 have been omitted from the figure.

As can be seen from the figure, the sheet 40 has a width "W", which is aligned parallel to the carriage guide rod 22; i.e. parallel to the scan axis of the four print cartridges 18. The sheet 40 also has a length "L", which is aligned perpendicular to the scan axis of the four print cartridges 18. Thus, as a series of swaths are printed on the sheet 40, each swath is printed along the width "W" of the sheet 40 and between each swath, the sheet 40 is advanced in a media advance operation in a direction parallel to its length relative to the four print cartridges 18.

In the present embodiment, each of the four print cartridges 18 is capable of printing a maximum swath of height "S", as is shown in FIG. 2.

Prior to commencing printing, the sheet 40 is positioned such that its leading edge 40*a*, or the leading edge of the image area of the sheet 40, is parallel to the trailing edge 18*a* of the nozzles of the four print cartridges 18. In this manner it is correctly positioned to receive the first swath when printing starts.

The processor 20 also determines the length "L" of the image to be printed. The processor 20 then calculates the optimum distance "F" by which to advance the sheet 40 between swaths, where:

$$F=L/(INT(L/S)+1)$$

In this example, as can be seen from the figure, the length "L" of the sheet is between 2 and 3 times the swath height "S". Therefore, "INT (L/S)" yields 2. Consequently, "F" is equal to "L/3". Expressed differently, the difference of each media advance is made equal to one third of the length "L" of the image to be printed.

In this manner the value of "F" is calculated such that the length "L" of the image to be printed is a whole number multiple of the print media advance "F". Furthermore, "F" is calculated to be largest fraction of the maximum swath of height "S" four print cartridges 18 that may be multiplied by an integer number to yield the length "L" of the image to be printed. In this manner, the distance by which the media must be advanced in order to print the image is minimised whilst avoiding increasing the number of swaths required to print the image.

The processor 20 then divides the image data to be printed into an integer number of swaths, each of height equal to distance "F", or "L/3". This is carried out using a standard "swath processing" technique as is well understood in the art. In the present example, the image is divided into three equal swaths, with one swath being printed in each pass.

In order that each swath printed is the same height as the distance "F", by which the sheet will be advanced between the printing of swaths, a reduced number of nozzles are used to print each swath. The reduced swath height is referenced "R" in the figure. As can be seem from the figure, the nozzles forming part of the reduced swath height "R" occupy the trailing positions in each of the four print cartridges 18. The deselected portion of the maximum swath height of the four print cartridges 18 is referenced "X" in the figure. The nozzles forming part of the deselected portion of the maximum swath height occupy the leading positions in the four print cartridges 18, indicated by the shaded region.

Since the feed distance "F" is equal to the reduced swath height "R", the registration between the leading edge of the one swath and the trailing edge of the subsequent swath are printed so as to give rise to no mis-registration; i.e. they are positioned to abut one another exactly.

The first swath, indicated by arrow "P1", is then printed as the four print cartridges 18 move from position "A" relative to the sheet 40, to the right hand side of the sheet 40, as viewed in the figure. The sheet 40 is then advanced relative to the four print cartridges 18 by the calculated distance "F"; indicated by the arrow "F1" in the figure. The new position of the four print cartridges 18 relative to the sheet 40 is shown at position "B". The second swath, indicated by arrow "P2", is then printed right to left as viewed in the figure. The sheet 40 is then advanced a second time relative to the four print cartridges 18; again by the by the feed distance "F"; indicated by the arrow "F2" in the figure. The new position of the four print cartridges 18 relative to the sheet 40 is shown at position "C". The image is then completed by the printing of the third swath, indicated by arrow "P3", in the direction left to right as viewed in the figure.

As is appreciated in the art of inkjet printers, the life of each nozzle in a print head is related to the number of individual drops that it prints. Therefore, the skilled reader will appreciate that in order to maximise the life of a given printhead, it is desirable to use the nozzles equally. For this reason, the skilled reader will appreciate that it is possible to the change position of the reduced swath height "R", relative to the printheads periodically between print jobs; i.e. to use different nozzles of the printheads. For example, the nozzles forming part of the reduced swath height "R" could be located in the leading portion, or indeed a central portion, of the printhead.

Second Embodiment

The second embodiment fulfils a similar function as described with reference to the first embodiment and employs the same apparatus. Therefore, like structures, functions and procedures will not be described further in detail with respect to the second embodiment. Additionally, the same reference numerals will be used to reference like items and processes.

Figure 3:
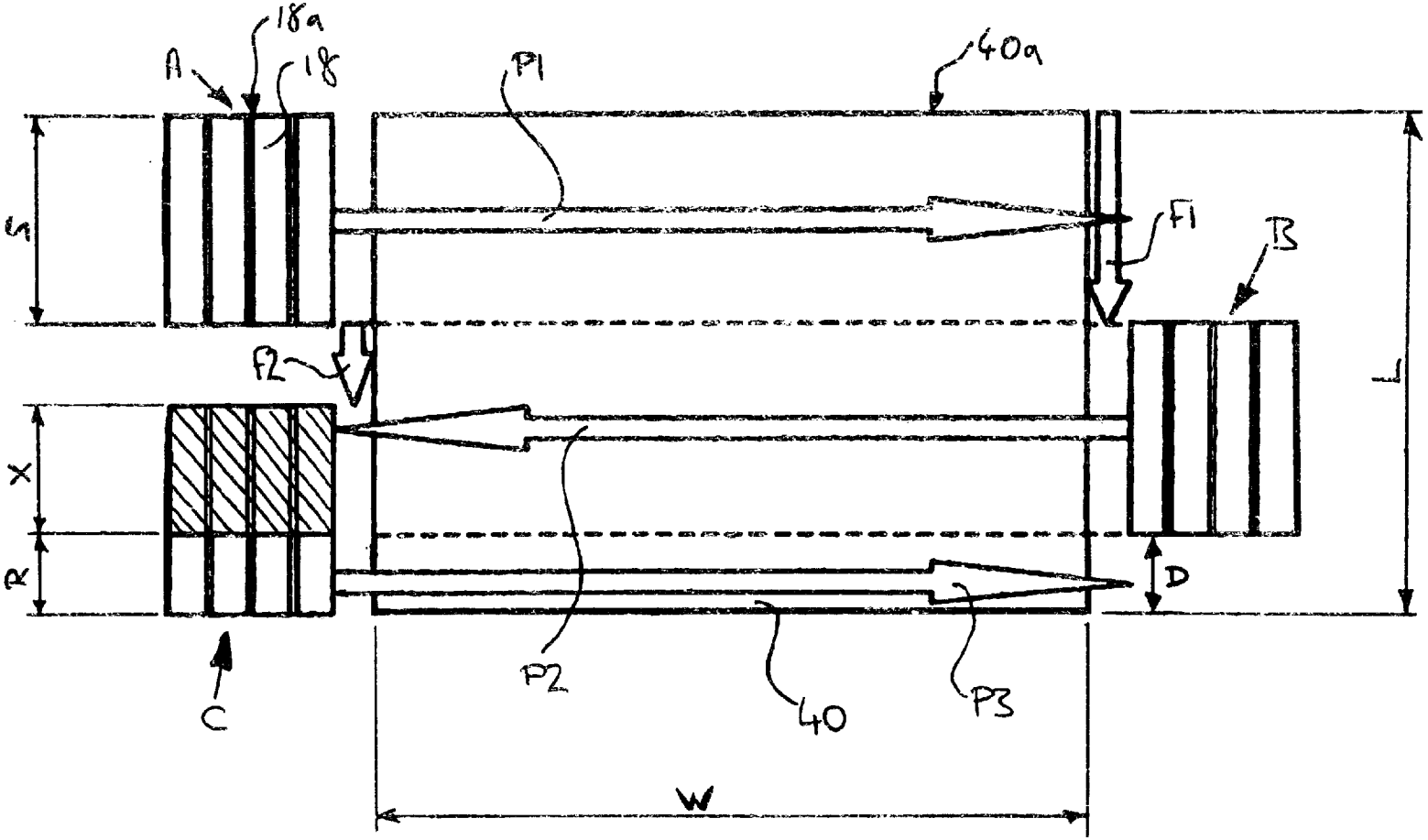
FIG. 3 schematically illustrates the mode of operation of the second embodiment of the invention.

Referring to FIG. 3, the operation of the present embodiment of the invention will now be described.

FIG. 3 illustrates a view, similar to that of FIG. 2, of a sheet of print media 40 as it is printed on in the print zone 14 of the printer 10, according to the method of the present embodiment.

As was the case with FIG. 2, the position of the four print cartridges 18 are shown relative to the sheet 40, at three separate instants during the printing of an exemplary image on the sheet 40.

In the same manner as was described with reference to the first embodiment, the leading edge 40*a* of the image area of the sheet 40 is positioned parallel to the trailing edge 18*a* of the nozzles of the four print cartridges 18 prior to printing.

The processor 20 divides the image data to be printed into a number of swaths, again using a conventional "swath processing". However, in the present embodiment the full swath height of each of the print cartridges 18 is used. Thus, in the present example, this gives rise to two swaths of full height and a third, ultimate swath of reduced height.

According to the present embodiment, the full height swaths are printed in a conventional manner. Thus, the first swath, indicated by arrow "P1", is printed as the four print cartridges 18 move from position "A" relative to the sheet 40, to the night hand side of the sheet 40, as viewed in FIG. 3. The sheet 40 is then advanced relative to the four print cartridges 18 by the conventional media advance distance, which is equal to the full swath height of the print cartridges 18. In FIG. 2, this is represented by the arrow "F1". The subsequent position of the four print cartridges 18 relative to the sheet 40 is shown at position "B". The second swath, indicated by arrow "P2", is then printed right to left as viewed in the figure. However, according to the present embodiment, instead of advancing the sheet 40 by the same distance as in the previous media advance, illustrated by arrow F1, a reduced media advance is implemented. The reduced media advance is illustrated by the arrow "F2". The distance that the sheet 40 is advanced by the media advance "F2" is equal to the height "D" of the final swath that remains to be printed in order to finish printing the image.

The position of the four print cartridges 18 relative to the sheet 40 is thus shown at position "C".

The image is then completed by the printing of the third swath, indicated by arrow "P3", in the direction left to right as viewed in the figure. As can be seen from FIG. 3, the last swath "P3" is printed using a reduced swath height "R". However, as can be seem from the figure, the nozzles used to print the reduced swath height "R" occupy the leading positions in each of the four print cartridges 18. The deselected portion of the maximum swath height of the four print cartridges 18, is referenced "X" in the figure. The nozzles forming part of the deselected portion of the maximum swath height occupy the trailing positions in the four print cartridges 18, indicated by the shaded region.

In this manner, the total distance that the media must be fed in order to print the entire image is reduced relative to the prior art, without increasing the number of swaths required to print the image. Thus, the time required to print the imaged may be reduced and the throughput of the printer correspondingly increased.

Like the method of the first embodiment, the method of the second embodiment may provide significant throughput advantages relative to the prior art printing methods. However, the skilled reader will appreciate that In certain situations, the throughput advantages which may be realised through the method of the first embodiment may be significantly greater than those possible through the method of the second embodiment.

This reason for this is as follows. In practise, there is a minimum time required by the print carriage between finishing printing one swath and commencing the subsequent swath. This "overtravel time" is required in order that the printheads may be decelerated from their printing speed to zero and subsequently accelerating the printheads once again in the reverse direction back to their printing speed prior commencing the printing of the subsequent swath. Generally, the "overtravel time" is invariant during the printing of an image.

The method of the first embodiment ensures that every swath making up an image will be more than half of the maximum swath height of the print cartridges 18 and in most cases will be a significantly larger proportion than half. Thus, the time for each media advance in the method of the first embodiment has been found by the inventors to be generally assured of being greater than the overtravel time. However, using the method of the second embodiment, the swath height of the final swath may be any proportion of the maximum swath height of the print cartridges 18. If the swath height of the final swath is small, it is likely that the corresponding media advance time will be less than the overtravel time. In such instances, the total media feed time for printing the whole image will be less well optimised using the method of the second embodiment than using the method of the first embodiment.

Further Embodiments

In the above description numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

For example, the skilled reader will appreciate that although the above embodiments were described with reference to a desk-top inkjet printer, it will be understood that the present invention may be applied to a wide range of printers; such as wide format printers, copiers, and facsimile machines. The skilled reader will also appreciate that the principals of the present invention can also be applied with benefit to optical scanners that employ a scanning head, which scans an image in a series of swaths.

Furthermore, the skilled reader will appreciate that although the printed swath heights were constant for the majority of the swaths in the examples given in the described embodiments, this need not be the case in practice. The exact height of each swath and thus the distance that the print media is advanced between swaths, may be substantially varied during the printing of an image in the case of both embodiments.

Although the above described embodiments described the printing of an image on to a pre-cut sheet of print media, the skilled reader will appreciate that in practice roll supplied print media may also be used.

As will be apparent to the skilled reader, in recent times, swath processing, together with many other image data processing tasks, is generally performed or internally in the printer, in order to allow the host PC to be freed up for other tasks as soon as possible. However, it will be appreciated that the present invention may be implemented with such processes being instead carried out outside the printer; for example, in the printer driver software running on the host PC.

What is claimed is:

1. An inkjet device comprising a printhead and a media advance mechanism, the printhead being arranged to print swaths aligned in a first direction, each swath having a maximum width S in a second direction substantially perpendicular to said first direction, said media advance mechanism being arranged to feed a print medium relative to said print head to position said swaths in the second direction on the print medium, the device being arranged to print an image having a length L in said second direction and comprising a plurality of swaths spaced apart in said second direction, said device being further arranged to reduce the width of each of said plurality of swaths to approximately equal L/(INT(L/S)+1) in order to reduce the total time to feed said print medium.

2. An device according to claim 1, wherein device is an inkjet printer.

3. An device according to claim 2, wherein device is a desktop printer.

4. A copier apparatus comprising an inkjet device according to claim 1.

5. An inkjet device comprising a printhead comprising a plurality of nozzles having a maximum swath height and arranged to print swaths aligned in a first direction and having a height in a second direction substantially perpendicular to said first direction, the device further comprising a media advance mechanism being arranged to feed a print medium relative to said print head to position said swaths in the second direction on the print medium, the device being arranged to print an image having a length in said second direction and comprising a plurality of swaths arranged contiguously in said second direction, said plurality of swaths being of substantially equal reduced swath height, less than said maximum swath height, said reduced swath height being approximately equal to the largest fraction of the maximum swath height for which the image length is an integer multiple.

6. An inkjet device comprising a printhead having a plurality of nozzles having a maximum swath height and arranged to print swaths aligned in a first direction, each swath having a width in a second direction substantially perpendicular to said first direction, the device further comprising a media advance mechanism arranged to feed a print medium relative to said print head to position said swaths in the second direction on the print medium, the device being arranged to print an image having a length in said second direction and comprising a plurality of swaths spaced apart in said second direction, said device being further arranged to print one or more swaths using the maximum swath height of said printhead and in dependence upon said image length to print a swath of reduced width with nozzles located in the leading portion of said printhead to reduce the total time to feed said print medium.

7. An inkjet device comprising a scan axis and a printhead arranged to move along said scan axis and to print on a print medium swaths aligned with said scan axis and having a maximum width S in a second direction substantially perpendicular to said scan axis, said device being arranged to periodically feed said print medium in said second direction relative to said printhead and to print an image having a printed length L in said second direction in a plurality of contiguous swaths on said print medium, said device being arranged to reduce the width of each of said plurality of swaths and corresponding media feeds to substantially equal L/(INT(L/S)+1) in order to reduce the total media feed time.

8. A method of printing an image with an inkjet device, the device comprising a printhead and a media advance mechanism, the printhead being arranged to print swaths aligned in a first direction, each swath having a width in a second direction substantially perpendicular to said first direction, said media advance mechanism being arranged to feed a print medium relative to said printhead to position said swaths in the second direction on the print medium, the method comprising the steps of:

determining the length of the image in the second direction;

determining the widths of the swaths with which said image is to be printed such that the width of each of said swaths is reduced to approximately equal L/(INT(L/S)+1), where L is equal to the printed image length in the second direction and S is equal to the maximum swath height of the printhead.

9. A method according to claim 8, wherein each said swath is printed using printhead nozzles located in the leading portion of the printhead.

10. A method according to claim 8, wherein each said swath is printed using printhead nozzles located in the trailing portion of the printhead.

11. A method according to claim 8, wherein each said swath is printed using printhead nozzles located in the central portion of the printhead.

12. A method according to any one of claim 9, 10 or 11 wherein the portion of the printhead used to print each said swath is periodically varied between printing images.

13. A method according to claim 8, wherein the step of determining the swath widths further comprises the step of setting each swath width value such that the estimated feed time for each media feed is greater than the overtravel time.

14. A method according to claim 8, wherein the image is printed using a bi-directional printmode.

15. A method according to claim 8, wherein a media feed is implemented in between every consecutive pair of swaths.

16. A method according to claim 8, wherein the step of determining the swath widths is carried out by a processor associated with said printer.

17. A method according to claim 8, wherein the step of determining the swath widths is carried out by a processor associated with a host device associated with said printer.

18. A method of printing an image with an inkjet device, the device comprising a printhead and a media advance mechanism, the printhead being arranged to print swaths aligned in a first direction, each swath having a width in a second direction substantially perpendicular to said first direction, said media advance mechanism being arranged to feed a print medium relative to said printhead to position said swaths in the second direction on the print medium, the method comprising the steps of:

determining the length of the image in the second direction;

determining the widths of the swaths with which said image is to be printed such that each said swath is reduced to a swath width which is approximately equal to the largest fraction of the maximum swath height of said printhead for which the said image length is an integer multiple.

19. A method according to claim 8 or 18, further comprising the step of implementing a proportionally reduced media feed prior to printing each said swath.

20. A computer program for implementing the steps of claim 8 or 18 or any one of claims 13 to 16 or claims 18 to 22, when run on a processor associated with suitable hardware.

21. A scanning inkjet device comprising a printhead arranged to print swaths of image content aligned in a first direction, each swath having a width in a second direction substantially perpendicular to said first direction and having a maximum swath width S, said device comprising a media advance mechanism arranged to feed a print medium relative to said print head to position said swaths in said second direction on said print medium, said device being arranged to print an image having a length L in said second direction in a number of contiguous swaths equal to INT(L/S)+1 where L/S is not an integer, each swath having a reduced width approximately equal to L/(INT(L/S)+1).

22. A scanning inkjet device comprising a printhead arranged to print swaths of image content aligned in a first direction and having a maximum swath width, said device comprising a media advance mechanism arranged to feed a print medium relative to said print head to position said swaths in said second direction relative to said print medium, said device being arranged to print an image having a length in said second direction in a plurality of swaths, each of said plurality of swaths having substantially the same swath width being less than said maximum swath width and substantially equal to the largest fraction of the maximum swath width for which the said image length is an integer multiple.

23. A method of printing with an inkjet device arranged to print on print media swaths of image content aligned in a first direction and having a width in a second direction substantially perpendicular to said first direction, the method comprising the steps of:

for an image having a printed length L in said second direction, determining the minimum number of swaths required to print said image; and, where this is not an integer, setting the width of each of said determined number of swaths to approximately equal L/(INT(L/S)+1), where S is equal to the maximum printable swath width.

* * * * *